US011905775B2

(12) United States Patent
Gao et al.

(10) Patent No.: US 11,905,775 B2
(45) **Date of Patent: *Feb. 20, 2024**

(54) DRIVING SYSTEM FOR CORE DRILLING RIG

(71) Applicants: SHENZHEN UNIVERSITY, Guangdong (CN); SICHUAN UNIVERSITY, Sichuan (CN)

(72) Inventors: Mingzhong Gao, Sichuan (CN); Heping Xie, Sichuan (CN); Ling Chen, Sichuan (CN); Jun Guo, Sichuan (CN); Zhilong Zhang, Sichuan (CN); Zetian Zhang, Sichuan (CN); Yiqiang Lu, Sichuan (CN); Cong Li, Sichuan (CN); Zhiqiang He, Sichuan (CN)

(73) Assignees: SHENZHEN UNIVERSITY, Guangdong (CN); SICHUAN UNIVERSITY, Sichuan (CN)

( * ) Notice: Subject to any disclaimer, the term of this patent is extended or adjusted under 35 U.S.C. 154(b) by 391 days.

This patent is subject to a terminal disclaimer.

(21) Appl. No.: 17/309,234

(22) PCT Filed: Nov. 12, 2018

(86) PCT No.: PCT/CN2018/114964

§ 371 (c)(1),
(2) Date: Mar. 11, 2022

(87) PCT Pub. No.: WO2020/093412

PCT Pub. Date: May 14, 2020

(65) Prior Publication Data

US 2022/0213745 A1 Jul. 7, 2022

(30) Foreign Application Priority Data

Nov. 8, 2018 (CN) ..... 201811327012.X

(51) Int. Cl.
*E21B 25/02* (2006.01)
*E21B 23/04* (2006.01)
(Continued)

(52) U.S. Cl.
CPC ..... *E21B 23/0418* (2020.05); *E21B 4/02* (2013.01); *E21B 4/18* (2013.01); *E21B 21/10* (2013.01); *E21B 25/00* (2013.01); *E21B 25/02* (2013.01)

(58) Field of Classification Search
CPC ..... E21B 25/02; E21B 25/04
See application file for complete search history.

(56) References Cited

U.S. PATENT DOCUMENTS 1,878,141 A * 9/1932 Hild ..... E21B 3/06 173/148
3,603,407 A * 9/1971 Clark ..... E21B 7/124 175/6

(Continued)

FOREIGN PATENT DOCUMENTS

CA 1285550 C 7/1991
CN 105275720 A 1/2016

(Continued)

*Primary Examiner* — Giovanna Wright
(74) *Attorney, Agent, or Firm* — NKL Law; Allen Xue

(57) ABSTRACT

A driving system for a core drilling rig has a driving motor. The driving motor has an outer rotor and an inner stator, and mutually-matched convex ribs are provided on the inner wall of the outer rotor and the outer wall of the inner stator. The outer rotor and the inner stator are in clearance fit. A clearance between the outer rotor and the inner stator is a driving liquid channel. The length of the outer rotor is less than that of the inner stator. The outer rotor is provided between the front and rear ends of the inner stator. The outer rotor is connected to an outer cylinder. The rear end of the inner stator is connected to a coupling.

8 Claims, 10 Drawing Sheets

(51) Int. Cl.

| | |
|---|---|
| ***E21B 4/02*** | (2006.01) |
| ***E21B 4/18*** | (2006.01) |
| ***E21B 21/10*** | (2006.01) |
| ***E21B 25/00*** | (2006.01) |

(56) References Cited

U.S. PATENT DOCUMENTS

| | | | | |
|---|---|---|---|---|
| 4,773,489 | A * | 9/1988 | Makohl | E21B 4/02<br>175/246 |
| 6,371,221 | B1 | 4/2002 | Harrigan et al. | |
| 2022/0213746 | A1* | 7/2022 | Xie | E21B 4/18 |

FOREIGN PATENT DOCUMENTS

| | | | |
|---|---|---|---|
| CN | 106761382 | A | 5/2017 |
| CN | 107165597 | A | 9/2017 |

* cited by examiner

DRIVING SYSTEM FOR CORE DRILLING RIG

TECHNICAL FIELD

The present invention relates to a core drilling system, and especially to a driving system of core drilling rig.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out rock samples.

The downhole temperature is high, and electrical equipment cannot be used. Mechanical structures are required to control the various steps of the drilling rig equipment.

CONTENT OF THE INVENTION

The present invention is intended to provide a driving system for the core drilling rig, that can be matched with a ground device to control a downhole device of the core drilling rig to work according to the coring steps, so as to realize long-distance mud-driven drilling and coring, as well as to provide the driving system with high efficiency, stepless speed change, and micro-disturbance. In order to realize the above objectives, the technical solutions adopted by the present invention are as follows:

The driving system for a core drilling rig disclosed in the present invention comprises a driving motor. The driving motor comprises an outer rotor and an inner stator, and mutually-matched convex ribs are provided on the inner wall of the outer rotor and the outer wall of the inner stator. The outer rotor and the inner stator are in clearance fit. A clearance between the outer rotor and the inner stator is a driving liquid channel. The length of the outer rotor is less than that of the inner stator. The outer rotor is provided between the front and rear ends of the inner stator. The outer rotor is connected to an outer cylinder. The rear end of the inner stator is connected to a coupling. Further, a hydraulic pump is connected behind the driving liquid channel.

Further, the outer cylinder is provided with a driving liquid outlet, and the driving liquid outlet is in front of the outer rotor.

Further, the inner stator penetrates back and forth, and further includes a central rod, which passes through the inner cavity of the inner stator and the coupling, and the central rod is connected to a core barrel, that is in front of the inner stator.

Further, comprises a fluid channel activation module, an outer cylinder, an outer cylinder unlocking module, a flow diverging module, and a drill bit. The central rod passes through, from the rear to the front, the inner cavities of a fluid channel activation module, an outer cylinder unlocking module, and a flow diverging module. The fluid channel activation module is behind the outer cylinder, and the fluid channel activation module is connected to the outer cylinder unlocking module; the flow diverging module is in front of the outer cylinder unlocking module, and the front of the flow diverging module is connected to a driving motor. The outer wall of the outer cylinder is fixedly connected with a centralizer, and the front end of the outer cylinder is connected to a drill bit.

Furthermore, the centralizer comprises a plurality of centralizing blocks, which are uniformly fixed on the outer wall of the outer cylinder along the circumference. The radian of the outer side of the centralizing block is the same as that of the outer wall of the outer cylinder, and the distance from the outer side of the centralizing block to the axis of the outer cylinder is greater than the radius of the outer cylinder, while the distance from all the centralizing blocks to the rear end of the outer cylinder is equal. All the centralizing blocks have the same thickness, and the centralizing blocks are made of copper.

Further, the centralizer is in front of the driving section, and the centralizer is behind the outlet of the driving fluid.

Further, the fluid channel activation module is behind the inner stator, and the fluid channel activation module comprises a lock body, a locking rod, and a start shear pin. The locking rod is in the lock body, and the locking rod and the lock body are connected by the start shear pin. Said central rod is in the locking rod. The lock body comprises a sealing section A, and the locking rod comprises a sealing section B. The sealing section A and the sealing section B are in a sealing fit, while said sealing section B is in a sealing fit with the central rod. There is a fluid channel A between the central rod and the locking rod, and the locking rod has an outflow hole A, that communicates with the fluid channel A. The outflow hole A is behind the sealing section B. There is a fluid channel B between the lock body and the locking rod, and the fluid channel B is in front of the sealing section A. Before the start shear pin is cut, the outlet of the outflow hole A is at the sealing section A, and the front end of the fluid channel A is sealed. After the start shear pin is cut, the locking rod moves forward, the outlet of the outflow hole A is located in front of the sealing section A, and the fluid channel A and the fluid channel B are connected through the outflow hole A.

Further, said outer barrel unlocking module comprises the connecting pipe and the lock pin. The rear end of the connecting pipe is connected to the lock body, while the rear end of the lock pin is connected to the locking rod. The central rod passes through the inner cavity of the lock pin, and the lock pin is in the connecting pipe. The outer diameter of the front section of the connecting pipe is shorter than the inner diameter of the outer barrel, and the side wall of the front section of the connecting pipe has an unlocking hole. There is a groove A on the outer wall of the lock pin, while there is a groove B on the inner wall of the outer barrel. The pin is also included, the length of the pin is greater than the depth of the unlocking hole, and the pin is arranged in the unlocking hole. Further, the outer end of the pin is chamfered and/or the side surface of the groove B is inclined. The width of groove A is not less than the width of the inner end of the pin, while the width of the groove B is not less than the width of the outer end of the pin. The front end of the connecting pipe is in the outer barrel, and the pin is in front of the groove A. The inner end surface of the pin is in sliding fit with the outer wall of the lock pin, and the outer end of the pin is embedded in the groove B. After the start shear pin is cut, the locking rod drives the lock pin forward, the unlocking hole is directly opposite to the groove A, the inner end of the pin is embedded in the groove A, and the distance from the inner end surface of the pin to the inner wall of the outer cylinder is greater than the length of the pin.

Further, said flow diverging module includes a valve housing, a lock housing and a trigger mechanism. The central rod passes through the inner cavity of the valve housing. The valve housing is inside the lock housing, and the rear of the lock housing is connected to the connecting pipe. From back to front, the valve housing includes a sealing section C and a diversion section. The lock housing includes an inflow section B and an outflow section B from back to front. There is a fluid channel D between the central rod and the inflow section B, while there is a fluid channel E between the outer wall of the central rod and the inner wall of the valve housing. The back end of fluid channel D communicates with fluid channel B, and fluid channel E communicates with fluid channel D, and fluid channel E communicates with the cooling hole of the front drill bit. The inner diameter of the inflow section B is longer than the outer diameter of the sealing section C, while the outer diameter of the sealing section C is greater than the outer diameter of the diversion section, and the inner diameter of the outflow section B is equal to the outer diameter of the sealing section C. The outflow section B is provided with an outflow hole B, and the outflow hole B communicates with the driving liquid channel of the driving motor. Before stopping the drilling, the front end of sealing section C is in the inflow section B, and the fluid channel D and the outflow hole B are connected. After stopping the drilling, the sealing section C and the outflow section B are in a sealing fit, and the fluid channel D is separated from the outflow hole B. The front end of the lock housing is connected to the rear end of the coupling.

Further, said valve housing further includes a locking section A. The locking section A is connected to the front end of the diversion section. The lock housing also includes a locking section B, that is connected to the front end of the outflow section B. The inner wall of the outer barrel is connected to a safety gear. The trigger mechanism includes a locking sleeve, a fixing ring, and a safety gear. The lock housing passes through the inner cavity of the locking sleeve, and the outer wall of the locking section A is provided with a locking groove A. The locking section B has a locking hole A and a locking hole B, and the locking hole B is in front of the locking hole A. Both locking hole A and locking hole B are through holes. Locking hole A and locking hole B have the same size, and there are locking balls in both locking hole A and locking hole B. The diameter of the locking ball is greater than the depth of the locking hole A. The locking sleeve includes an impact section and the locking section C from back to front. The inner wall of the locking section C has a locking groove B and a locking groove C. The locking groove C is in the front of locking groove B. The distance between the locking groove B and the locking groove C is equal to the distance between the locking hole A and the locking hole B. The fixing ring is fixed on the outer wall of the locking section B, and the fixing ring is behind the locking hole A. The inner diameter of the impact section is longer than the outer diameter of the fixing ring. The locking section C is in front of the fixing ring. The safety gear includes the clamping part and the pressing part from back to front. The inner diameter of the front end of the pressing part is shorter than the outer diameter of the impact section, while the inner diameter of the pressing part is not less than the outer diameter of the fixing ring. The inner diameter of the front end of the clamping part is shorter than the outer diameter of the rear end of the fixing ring. There is a limit part in the central rod, and the limit part is in the locking section B and in front of the locking section A. The outer wall of the limit part is provided with a locking groove D, and the locking groove D is in front of the locking groove A. Moreover, a fluid channel F is opened inside the limit part. The fluid channel E is connected to the cooling hole of the front drill bit by the fluid channel F. The axial distance from the front end of the clamping part to the front end of the pressing part is equal to the axial distance from the center of the locking hole A to the center of the locking groove B before the drilling is stopped. Before stopping the drilling, the distance from the rear end of the sealing section C to the rear end of the outflow hole B is greater than the axial distance from the center of the locking hole A to the center of the locking groove A after stopping the drilling. After the drilling is stopped, the axial distance from the center of the locking hole A to the center of the locking groove A is greater than the distance from the front end of the sealing section C to the front end of the outflow hole B before the drilling is stopped. Further, there is a fluid channel C between the central rod, the lock pin and the locking rod, as well as the side wall of the locking rod is provided with an inflow hole. The fluid channel B communicates with the fluid channel C through the inflow hole, while the fluid channel C communicates with the fluid channel D. The connecting pipe includes a pressure-relief section and a choke section from back to front. The lock pin and the choke section are in a sealing fit, and the inner diameter of the choke section is shorter than the inner diameter of the pressure-relief section. The pressure-relief section is provided with a pressure-relief hole, and the pressure-relief hole is a through hole. There is a shearing plunger in the fluid channel B, and the inner diameter of the shearing plunger is longer than the outer diameter of both the lock pin and the locking rod. The shearing plunger is connected to the lock body through the end shearing pin. The shearing plunger includes a shearing section and a recoil section from back to front. The outer wall of the shearing section is in a sealing fit with the inner wall of the lock body, and the outer diameter of the recoil section is equal to the inner diameter for the front part of the pressure-relief hole in the pressure-relief section. Before stopping the drilling, the front end of the recoil section is in front of the front end of the pressure-relief hole, and the recoil section is in a sealing fit with the front part of the pressure-relief hole in the pressure-relief section. After stopping the drilling, liquid backflow impacts the front end of the shearing plunger, and the shearing plunger moves backward. The front end of the recoil section is behind the front end of the pressure-relief hole, and the fluid channel B communicates with the pressure-relief hole.

Further, the outer wall of the locking rod and the inner wall of the lock body are provided with mutually matched limit steps.

Further, a lock nut is also included. The lock nut is behind the lock body, and the lock nut penetrates back and forth.

The central rod passes through the inner cavity of the lock nut, and the front end of the lock nut is threadedly connected with the rear end of the lock body. The start shear pin passes through the rear end thread of the lock body.

Further, the lock nut includes a fixed section and a threaded section. The outer diameter behind the step of the locking rod is shorter than the inner diameter of the fixed section, while the inner diameter of the fixed section is shorter than the outer diameter of the step of the locking rod. The threaded section is connected to the rear end of the lock body.

Further, said lock nut is axially provided with a fixing hole A, and the fixing hole A is a through hole. The lock body has a fixing hole B on the rear face, but the fixing hole B is a blind hole. The fixing hole A and the fixing hole B are paired. A fixing screw is also included, and the length of the fixing screw is greater than the depth of the fixing hole. The fixing screw is in the fixing hole A, and the front end of the fixing screw is inserted into the fixing hole B through the fixing hole A.

The present invention has the following beneficial effects:

1. The driving motor includes an inner stator and an outer rotor. The outer rotor drives the outer cylinder to rotate under the drive of the driving fluid. The rear end of the inner stator is connected to a coupling, so that the inner stator is slightly disturbed with the outer rotor. The hydraulic energy provided by the rear hydraulic pump is pumped into the drive liquid channel, and can achieve the effect of high power and stepless speed change;
2. Before starting, the start shear pin fixes the locking rod on the lock body, the outflow hole A is in the sealing section A, the outer wall opening of the outflow hole A is sealed, the fluid channel is blocked, the connecting pipe is connected to the lock body, and the outer end of the pin is inserted into the groove B, to lock the outer barrel on the connecting pipe. When the hydraulic pressure provided by the mud pump at the rear reaches the starting value, the start shear pin is broken, the locking rod moves forward, the fluid passes through the fluid channel A and enters the fluid channel B through the outflow hole A, and then flows into the fluid channel C through the inflow hole, followed by flowing through the flow diverging module. A part of the fluid passes through the fluid channel D, the fluid channel E, and the fluid channel F, and then reaches the cooling hole of the drill bit, to cool the drill bit. A part of the fluid passes through the fluid channel D and communicates with the drive liquid channel of the front driving motor through the outflow hole B. The hydraulic motor is started, and the locking rod moves forward to drive the lock pin forward, so that the groove A and the unlocking hole are directly opposite, and the outer barrel moves forwards due to the gravity itself. The contact surface between the groove B and the outer end of the pin is inclined, and the pin is squeezed into the groove A, to release the constraint of the outer barrel. The outer barrel is connected to working parts such as the drill bit, to move the drill bit forward;
3. Before stopping the drilling, the locking ball is in the locking hole A and the locking groove A, to lock the valve housing and keep the fluid channel D in communication with the drive liquid channel of the front hydraulic motor through the outflow hole B. When the outer barrel moves forward to the stop position, the outer barrel drives the safety gear to hit the locking sleeve, to move the locking sleeve forward. The locking groove B is directly opposite to the locking hole A, and the radial restraint of the locking ball is released. The fluid impacts the rear end of the valve housing, the locking ball is squeezed into the locking groove B, and the valve housing moves forward. The sealing section C separates the fluid channel D from the outflow hole B, that stops supplying energy to the front motor, and the motor is off. Because the fluid channel D is blocked, the liquid flows backwards, runs back to the fluid channel B, and recoils the front end of the shearing plunger. The shearing plunger receives the backward force and moves backward. The front end of the recoil section moves to behind the pressure-relief hole, the fluid channel B communicates with the outside through the pressure-relief hole, and the liquid is discharged from the pressure-relief hole;
4. The centralizer causes the drilling structure to be placed vertically in the dental drill, and the outer surface of the centralizer is in contact with the inner wall of the dental drill. When the outer cylinder is driven to rotate by the driving motor, the outer surface of the centralizer rubs against the inner wall of the dental drill, and the other parts of the outer cylinder are not in contact with the dental drill. The friction surface is reduced to prevent the abrasion of the outer cylinder. The centralizer can be replaced after abrasion, which extends the service life of the drilling structure.

Figure 1:
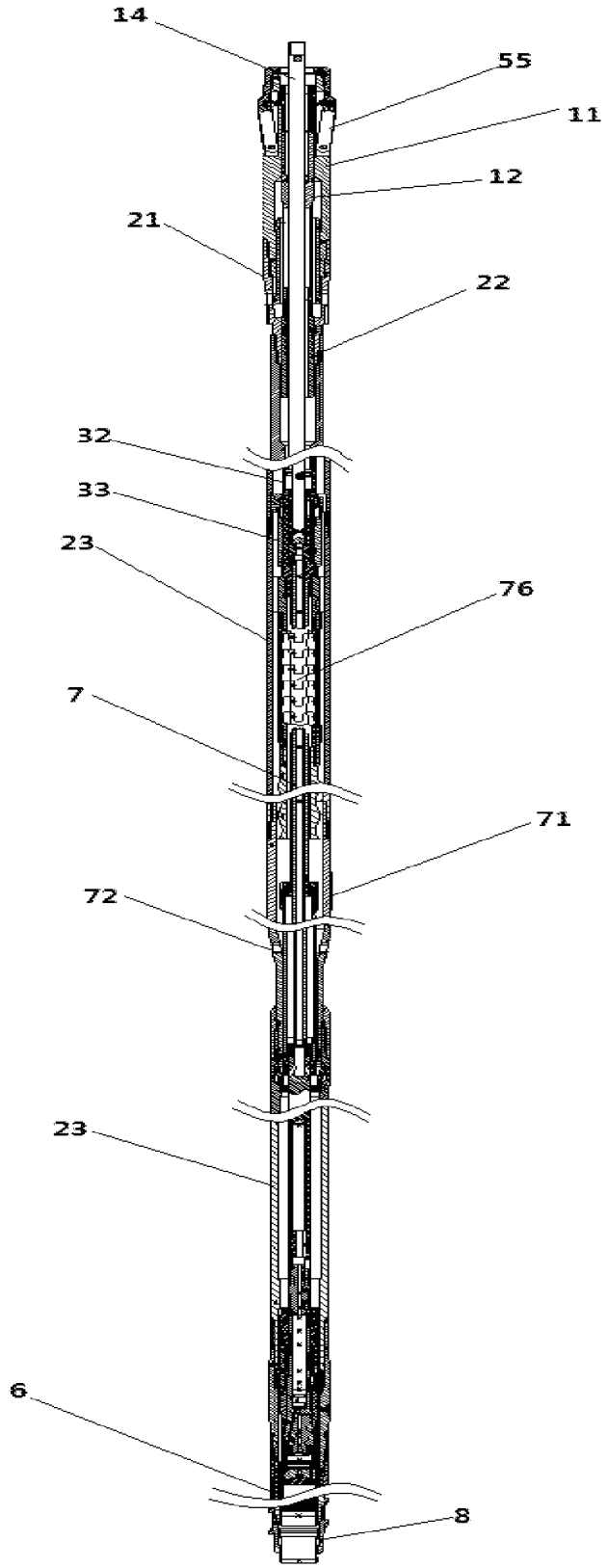
FIG. 1. Schematic diagram of coring system.
Figure 2:
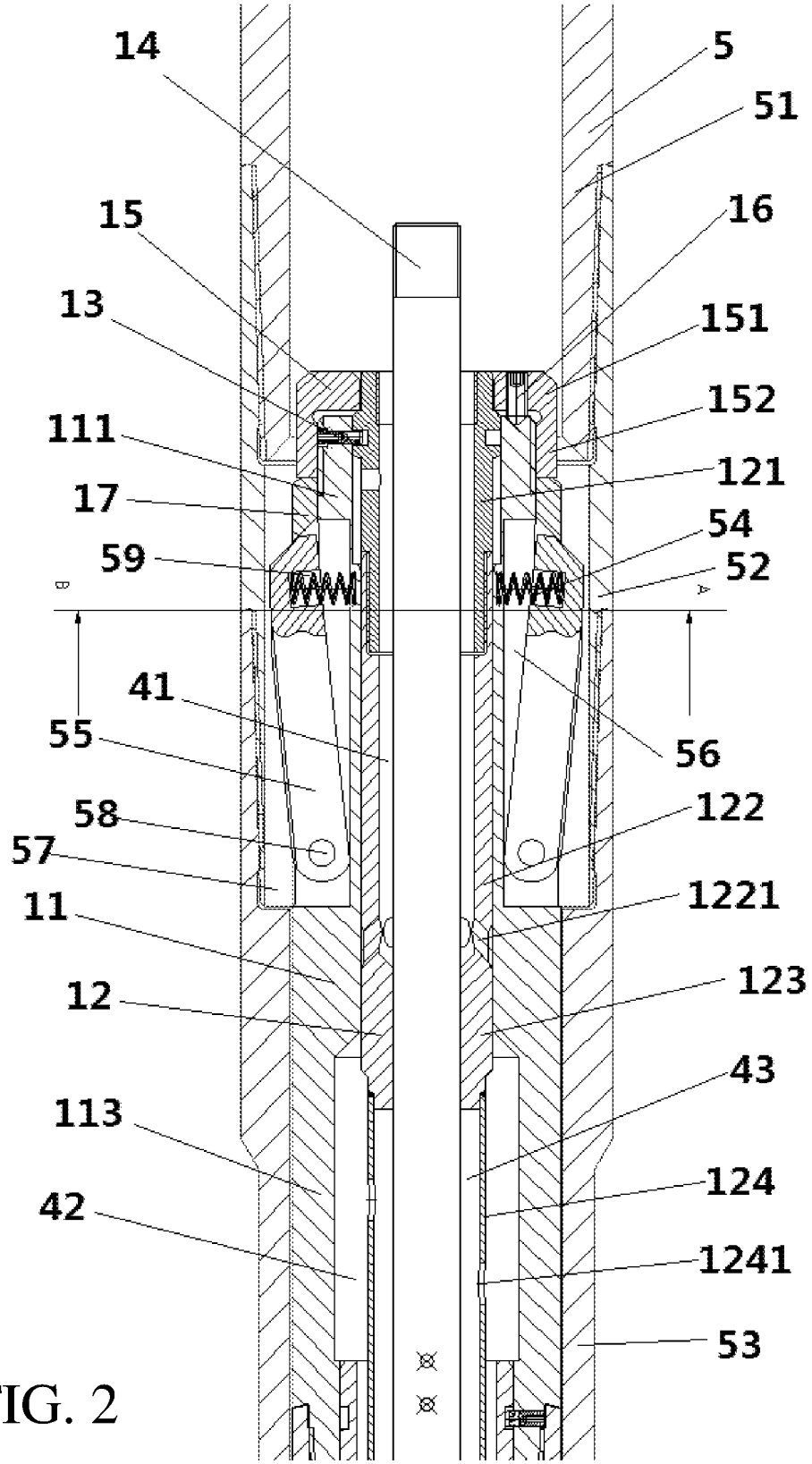
FIG. 2. Schematic diagram for interlocking of dental drill and core drilling rig.
Figure 3:
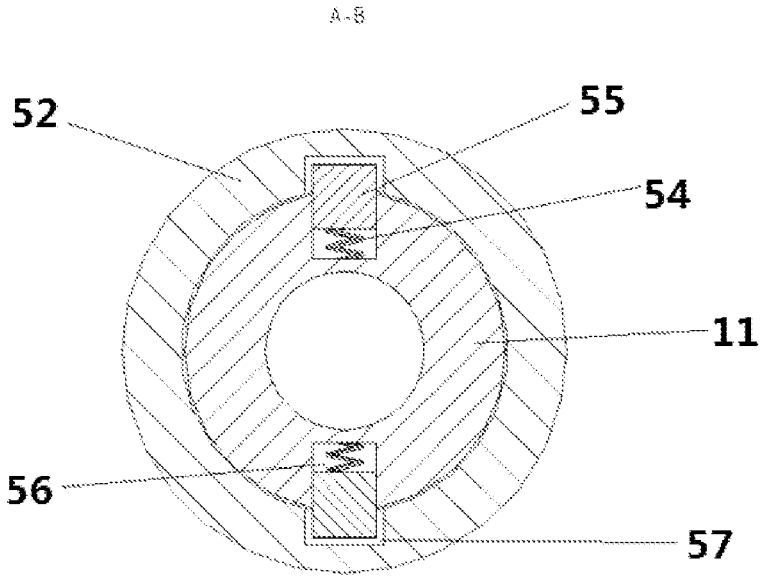
FIG. 3. A-B cross-sectional view.
Figure 4:
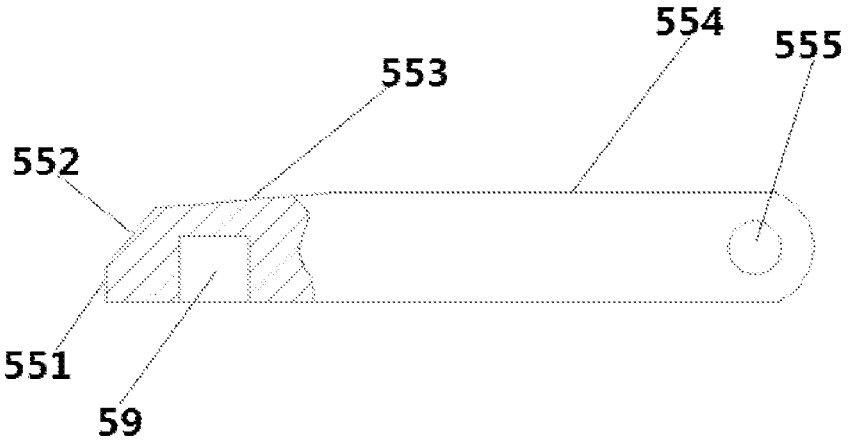
FIG. 4. Schematic diagram of the latch.
Figure 5:
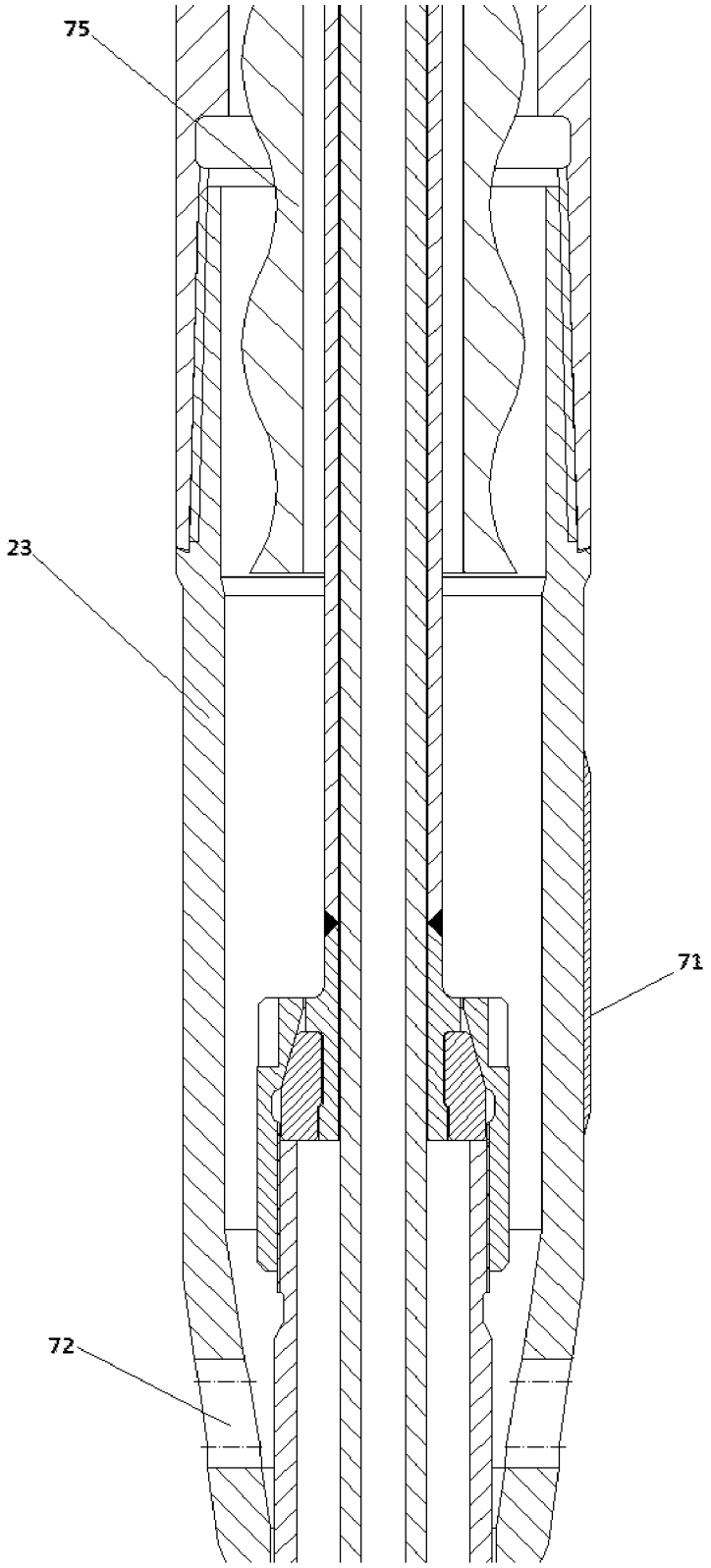
FIG. 5. Schematic diagram of the centralizer position.
Figure 6:
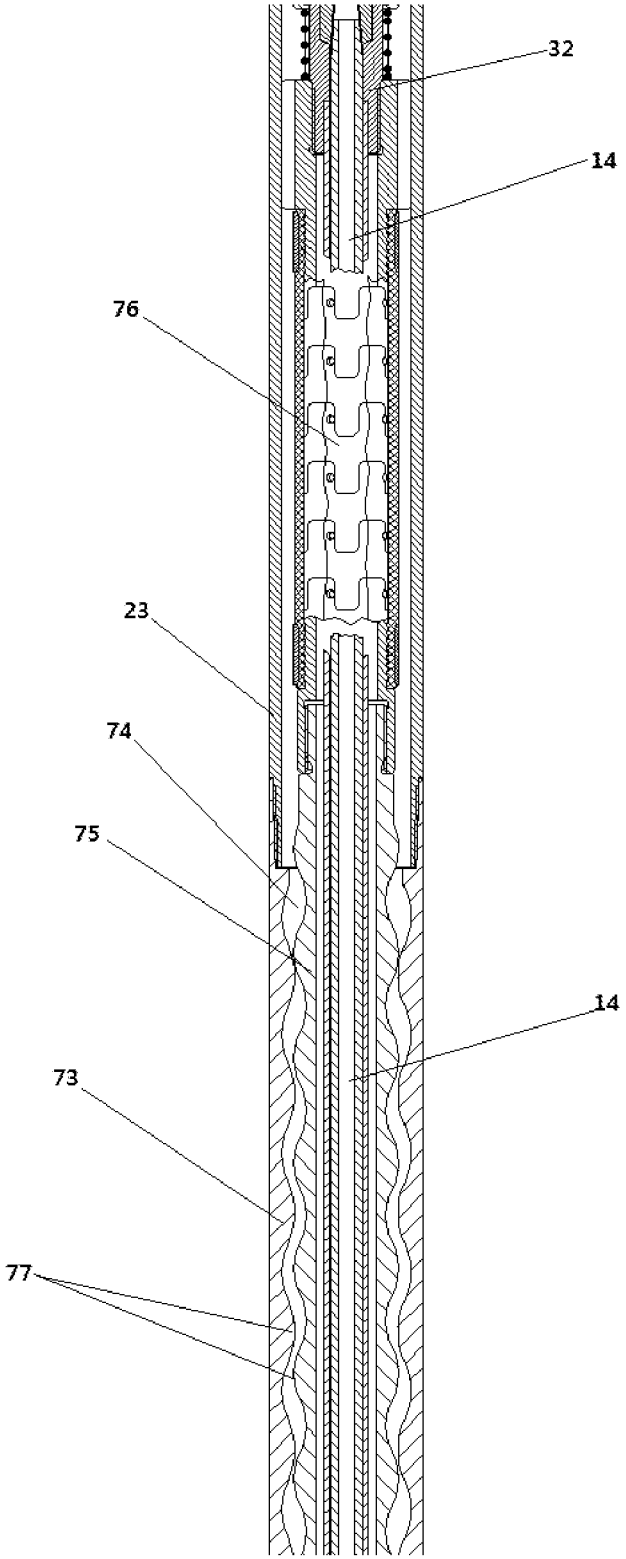
FIG. 6. Schematic diagram of the driving motor.
Figure 7:
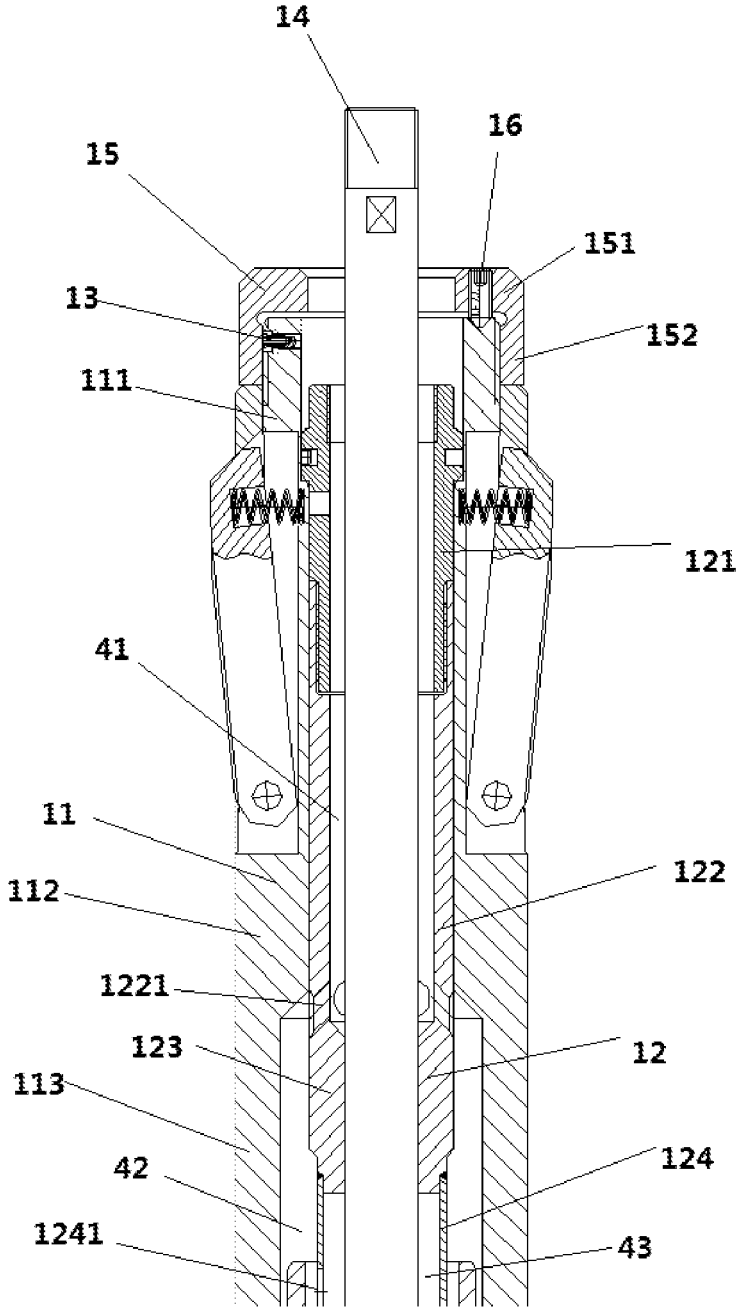
FIG. 7. Schematic diagram of the fluid channel activation module after starting.

In Figures: 11-lock body, 111-locking section, 112-sealing section A, 113-liquid channel section, 12-locking rod, 121-connecting section, 122-outflow section A, 1221-outflow hole A, 123-sealing section B, 124-inflow section A, 1241-inflow hole, 13-start shear pin, 14-central rod, 15-lock nut, 151-fixed section, 152-threaded section, 16-fixing screw, 17-sealing steel ring, 21-connecting pipe, 211-connecting section, 212-pressure relief section, 2121-pressure relief hole, 213-choke section, 22-lock pin, 221-groove A, 23-outer barrel, 231-groove B, 232-safety gear, 2321-clamping part, 2322-pressing part, 24-pin, 25-end shearing pin, 26-shearing plunger, 261-shearing section, 262-recoil section, 31-valve housing, 311-sealing section C, 312-diversion section, 313-locking section A, 3131-locking groove A, 32-lock housing, 321-inflow section B, 322-outflow section B, 3221-outflow hole B, 323-locking section B, 3231-locking hole A, 3232-locking hole B, 33-locking sleeve, 331-impact section, 332-locking section C, 3321-locking groove B, 3322-locking groove C, 34-locking ball, 35-fixing ring, 36-limit part, 361-locking groove D, 37-snap ring,

41-fluid channel A, 42-fluid channel B, 43-fluid channel C, 44-fluid channel D, 45-fluid channel E, 46-fluid channel F, 5-dental drill, 51-the first drill tube, 52-the second drill tube, 53-the third drill tube, 54-spring, 551-the rear face of the latch, 552-the first slope of the latch, 553-the second slope of the latch, 554-the axial face of the latch, 555-latch hole, 56-latch slot, 57-lock slot, 58-pin shaft, 59-spring hole, 61-coring barrel, 7-driving motor, 71-centralizing block, 72-driving fluid outlet, 73-outer rotor, 74-driving liquid channel, 75-inner stator, 76-coupling, 77-convex rib, 8-drill bit.

EXAMPLES

In order to make the objectives, technical solutions, and advantages of the present invention clearer, the present invention will be further illustrated hereinafter by combing with the attached Figures.

As shown in FIGS. 1-7, the core drilling rig includes a dental drill 5 and a coring system. The dental drill 5 is hollow, and the coring system is in the dental drill 5, and the outer wall of the coring system is in a sliding fit with the inner wall of the dental drill 5. The dental drill 5 comprises a first drill tube 51, a second drill tube 52, and a third drill tube 53 from back to front. The first drill tube 51 and the second drill tube 52 are detachably connected, and the second drill tube 52 and the third drill tube 53 are detachably connected. The front end of the first drill tube 51 is a male end, and the rear end of the second drill tube 52 is a female end, while the front end is a male end. The rear end of the third drill tube 53 is a female end. The inner wall of the second drill tube 52 is provided with a locking groove 57, that is arranged along the axial direction. The locking groove 57 penetrates the front and rear ends of the second drill tube 52. There are two locking grooves 57, and both of them are opposite.

The outer wall of the coring system is provided with latch grooves 56. Moreover, there are two latch grooves 56, and they are opposite. The latch grooves 56 are arranged along the axial direction. There is a latch 55 in the latch groove 56. Both of two side walls of the latch groove 56 are connected by a pin shaft 58, and the pin shaft 58 is a positioning pin. The latch 55 has a latch hole 555. The latch hole 555 is a through hole, and is adapted to the pin shaft 58. The pin shaft 58 passes through the latch hole 555, and the latch 55 is rotatably fit with the pin shaft 58. The distance from the latch hole 555 to the rear end of the latch 55 is greater than the distance from the latch hole 555 to the front end of the latch 55. The inner side of the latch 55 has a spring hole 59. The spring hole 59 is a round and blind hole. The distance between the spring hole 59 and the rear end of the latch 55 is less than the distance between the spring hole 59 and the front end of the latch 55. The bottom of the latch groove 56 has a recess corresponding to the spring hole 59. The spring 54 is installed in the spring hole 59 and the recess, and is in contact with the outer wall of the coring system and the latch 55. When the spring 54 bounces up, the latch 55 is partially embedded in the locking groove 57.

The outer side of the latch 55 includes an axial surface 554, a first inclined surface 552, and a second inclined surface 553. The rear end of the first inclined surface 552 of the latch is connected to the rear end surface 551 of the latch, and the front end of the first inclined surface 552 of the latch is connected to the rear end of the second inclined surface 553 of the latch, while the front end of the second inclined surface 553 of the latch is connected to the rear end of the latch axial surface 554. The front end of the latch axial surface 554 is connected to the front end surface of the latch. The rear end surface 551 of the latch is a flat surface, while the front end surface of the latch is a curved surface. The spring hole 59 and the recess are within the projection range of the second inclined surface 553 of the latch to the inner surface of the latch 55. The distances from the center of the latch hole 555 to the inner side and the outer side of the latch 55 are equal, and the total length of the latch 55 is 131 mm. The distance from the connection of the latch axial surface 554 and the second inclined surface 553 of the latch to the rear end surface 551 of the latch is 42 mm. The angle between the first inclined surface 552 of the latch and the radial section is 40°, while the angle of the second inclined surface 553 of the latch and the radial section is 85°. The arc surface radius of the front end surface of the latch is 11 mm, while the diameter of the latch hole 555 is 10 mm. The arc center of the front end surface of the latch coincides with the center of the latch hole 555. The diameter of the spring hole 59 is 13 mm, and the depth is 12 mm. The distance from the center of the spring hole 59 to the rear end surface 551 of the latch is 20 mm, and the width and thickness of the latch 55 are both 20 mm.

The coring system moves from back to front. When the locking groove 57 and the latch groove 56 are directly opposite, the latch 55 bounces up to engage the coring system with the dental drill 5. The left and right side walls of the latch 55 are matched with the locking groove 57, that restricts the circumferential movement of the coring system. The axial face 554 of the latch is inclined, and clamped with the inner wall of the rear end of the third drill tube 53, to restrict the coring system from moving forward.

The coring system comprises a driving system for a core drilling rig, that comprises a driving motor 7 and a center rod 14. The driving motor 7 comprises an outer rotor 73 and an inner stator 75, and mutually-matched convex ribs 77 are provided on the inner wall of the outer rotor 73 and the outer wall of the inner stator 75. The outer rotor 73 and the inner stator 75 are in clearance fit. A clearance between the outer rotor 73 and the inner stator 75 is a driving liquid channel 74, and the hydraulic pump is connected to the rear of the driving fluid channel 74. The length of the outer rotor 73 is less than that of the inner stator 75. The outer rotor 73 is provided between the front and rear ends of the inner stator 75. The outer rotor 73 is connected to an outer cylinder 23. The outer cylinder 23 has a driving liquid outlet 72, which is in front of the outer rotor 73. The rear end of the inner stator (75) is connected to a coupling (76). The inner stator 75 penetrates back and forth. The central rod 14 passes through the inner cavity of the inner stator 75 and the coupling 76. The central rod 14 is connected to a coring barrel 6, and the coring barrel 6 is in front of the inner stator 75.

The driving system of a core drilling rig comprises a fluid channel activation module, an outer cylinder 23, an outer cylinder unlocking module, a flow diverging module, and a drill bit 8. The central rod 14 passes through, from the rear to the front, the inner cavities of a fluid channel activation module, an outer cylinder unlocking module, and a flow diverging module. The fluid channel activation module is behind the outer cylinder 23, and the fluid channel activation module is connected to the outer cylinder unlocking module; the flow diverging module is in front of the outer cylinder unlocking module, and the front of the flow diverging module is connected to a driving motor 7. The outer wall of the outer cylinder 23 is fixedly connected with a centralizer, that is in front of the outer rotor 73 and behind the driving fluid outlet 72. The front end of the outer cylinder 23 is connected to a drill bit 8. The centralizer comprises a plurality of centralizing blocks 71, which are uniformly fixed on the outer wall of the outer cylinder 23 along the circumference. There is a gap between two adjacent centralizing blocks 71. The radian of the outer side of the centralizing block 71 is the same as that of the outer wall of the outer cylinder 23, and the distance from the outer side of the centralizing block 71 to the axis of the outer cylinder 23 is greater than the radius of the outer cylinder 23, while the distance from all the centralizing blocks 71 to the rear end of the outer cylinder 23 is equal. All the centralizing blocks 71 have the same thickness, and the centralizing blocks 71 are made of copper. The centralizing blocks 71 are in contact with the inner wall of the dental drill. Before the driving motor 7 is started, the driving system for the core drilling rig is vertically centered. After the driving motor 7 is started, the outer surface of the centralizing blocks 71 rubs against the inner wall of the dental drill 5, but the other parts of the outer cylinder 23 are not in contact with the inner wall of the dental drill 5. The small friction surface not only reduces system friction and energy loss, but also protects other parts of the outer wall of the outer cylinder 23 from friction and prevents damage.

Figure 8:
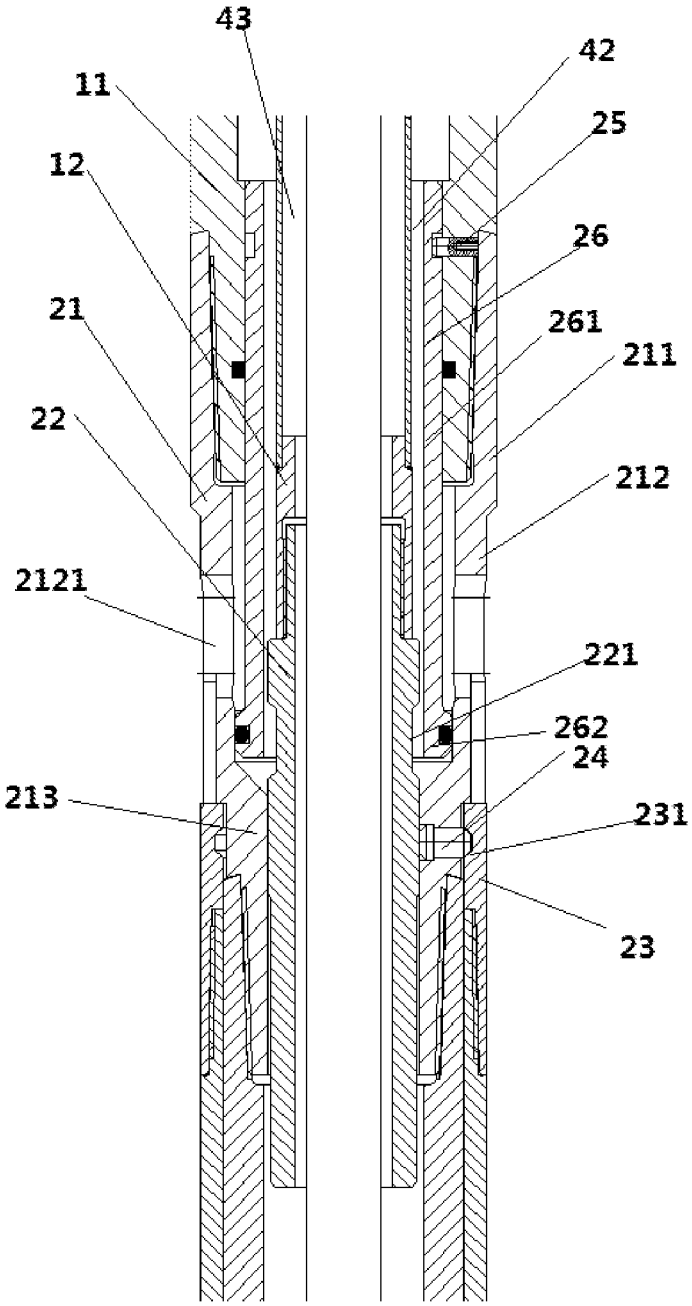
FIG. 8. Schematic diagram of the outer barrel unlocking module before starting.
Figure 9:
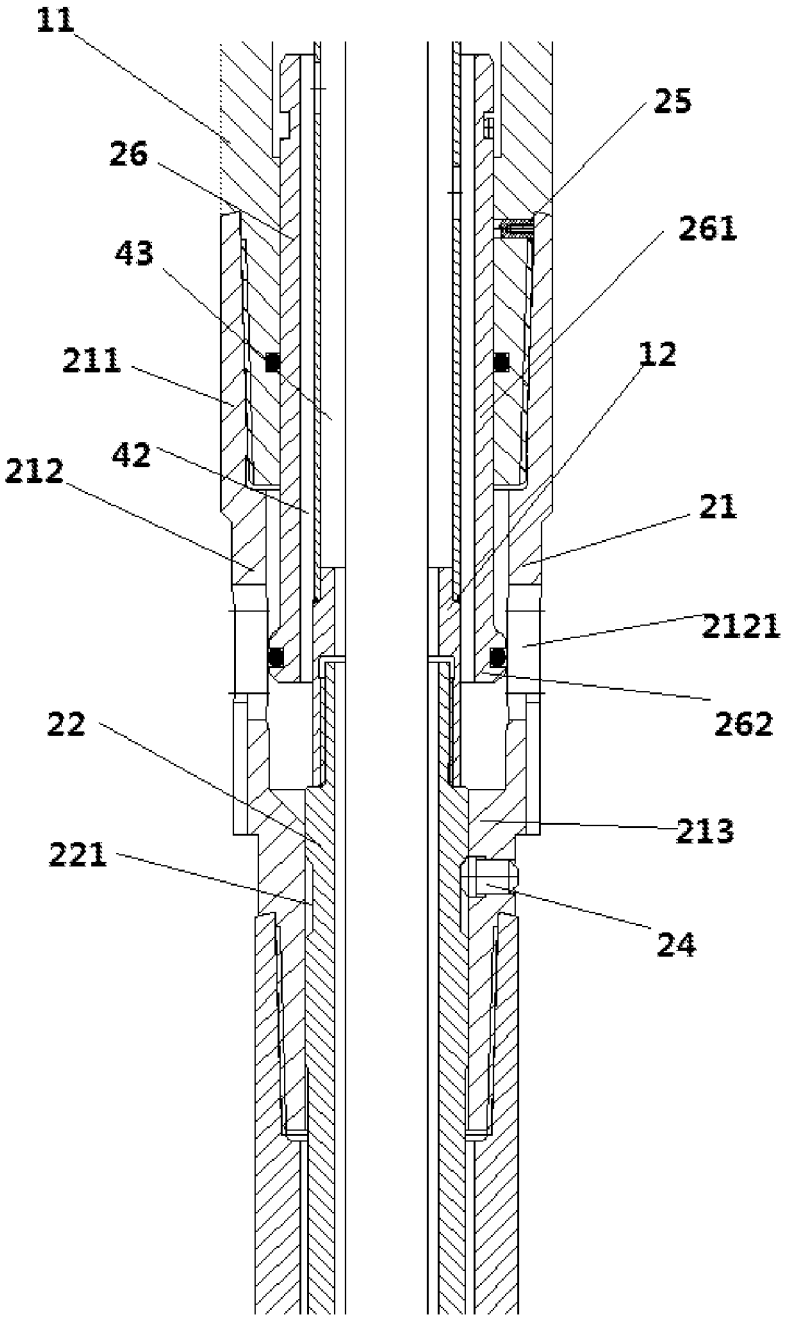
FIG. 9. Schematic diagram of the outer barrel unlocking module after stopping the drilling.

The fluid channel activation module includes a lock body 11, a locking rod 12, and a start shear pin 13. The lock body 11 penetrates back and forth, the latch groove 56 is on the outer wall of the lock body 11. For the lock body 11, the outer diameter of the part behind the latch groove 56 is shorter than that of the part in front of the latch groove 56. The lock body 11 consists sequentially of a locking section 111, a sealing section A 112, and a fluid channel section 113 from back to front. The side wall of the locking section 111 has a start shear pin hole, that is a through hole. The length of the start shear pin 13 is greater than its depth. The locking rod 12 penetrates back and forth, and the locking rod 12 is inside the lock body 11. The locking rod 12 includes a connecting section 121, an outflow section A 122, a sealing section B 123 and an inflow section A 124 from back to front. The connecting section 121 is threadedly connected with the outflow section A 122. The sealing section B 123 and the inflow section A 124 are welded. The outer wall of the connecting section 121 has a start shear pin groove, that is an annular groove. The start shear pin 13 is in the start shear pin hole and the start shear pin groove. The side wall of the outflow section A 122 is provided with an outflow hole A 1221, and the side wall of the inflow section A 124 is provided with an inflow hole 1241. The outflow hole A 1221 is inclined forward from the inside to the outside. There are multiple outflow holes A 1221, and these holes are evenly distributed along the circumference at the same axial position. There are multiple inflow holes 1241. The inflow holes 1241 are distributed in front and back on different sides. The inner diameter of the locking section 111 is longer than that of the sealing section A 112. The outer wall of the connecting section 121 has a step. whose outer diameter is longer than the inner diameter of the sealing section A 112. The outer diameter in front of the step of the connecting section 121 is equal to the inner diameter of the sealing section A 112. The start shear pin groove is on the outer wall of the step. The central rod 14 is in the locking rod 12. The sealing section A 112 and the sealing section B 123 are in a sealing fit. The inner diameter of the fluid channel section 113 is longer than the outer diameter of the locking rod 12. The inner diameter of the connecting section 121, the outflow section A 122 and the inflow section A 124 is greater than the outer diameter of the central rod 14, and the sealing section B 123 is in a sealing fit with the central rod 14. The axial distance from the front end of the sealing section A 112 to the rear end of the lock body 11 is less than the axial distance from the front end of the sealing section B 123 to the rear end of the lock body 11. The start shear pin 13 penetrates the start shear pin hole and is inserted into the start shear pin groove. The axial distance from the open in the outer wall of the outflow hole A 1221 to the rear end of the lock body 11 is shorter than the axial distance from the rear end of the fluid channel section 113 to the rear end of the lock body 11. A lock nut 15 and a sealing steel ring 17 are also comprised. The sealing steel ring 17 is connected to the lock body 11, and the sealing steel ring 17 is connected behind the latch groove 56. The outer diameter of the sealing steel ring 17 is same as that of the lock body 11 part in front of the latch groove 56. The inner wall of the rear section of the sealing steel ring 17 is in contact with the outer wall of the lock body 11, and the inner diameter of the rear section of the sealing steel ring 17 is shorter than the outer diameter of the lock body 11 in the front of it. The inner diameter of the front section of the sealing steel ring 17 gradually increases from back to front. The angle between the inner wall of the front section of the sealing steel ring 17 and the radial section is 45°. The front end surface of the sealing steel ring 17 is in the front of the rear end surface of the latch groove 56 and behind the second inclined surface 553 of the latch. The inner diameter of the sealing steel ring 17 at the rear end surface of the latch groove 56 is longer than the outer diameter of the lock body 11 here. The outer side surface of the latch 55 is in contact with the inner wall of the sealing steel ring 17. The outer diameter of the sealing steel ring 17 is 99.6 mm, and the inner diameter is 82 mm. The length of the sealing steel ring 17 is 23 mm, and the outer wall of the rear end of the sealing steel ring 17 has a 3 mm×45° chamfer. The outer diameter of the lock body 11 part behind the latch groove 56 is 82 mm. The lock nut 15 is behind the sealing steel ring 17. The lock nut 15 presses the sealing steel ring 17 tightly, and penetrates back and forth. The central rod 14 passes through the inner cavity of the lock nut 15. The front end of the lock nut 15 is threadedly connected with the rear end of the lock body 11. The start shear pin hole is opened at the thread of the rear end of the lock body 11. The radial distance from the inner wall of the lock nut 15 to the bottom of the start shear pin groove is not less than the length of the start shear pin 13. The lock nut 15 includes a fixing section 151 and a thread section 152. The outer diameter of the connecting section 121 part behind the step is shorter than the inner diameter of the fixing section 151, as well as shorter than the outer diameter of the step. The inner diameter of the thread section 152 is equal to the outer diameter of the locking section 111. The lock nut 15 has a fixing hole A in the axial direction, that is a through hole. The rear face of the lock body 11 has a fixing hole B, that is a blind hole. The fixing hole A is matched with the fixing hole B. A fixing screw 16 is also comprised. The length of the fixing screw 16 is greater than the depth of the fixing hole A. The fixing screw 16 is in the fixing hole A. The front end of the fixing screw 16 is inserted into the fixing hole B through the fixing hole A. After the fluid is provided, the locking rod 12 moves forward, and the start shear pin 13 is cut. The start shear pin head is in the start shear pin hole, while the start shear pin tail is in the start shear pin groove. The start shear pin head includes a big end and a small end, and the big end faces outside. In addition, the outer diameter of the big end is greater than that of the small end. The start shear pin hole includes an outer section and an inner section. The diameter of the outer section is not less than the outer diameter of the big end of the start shear pin, while the diameter of the inner section is not less than the outer diameter of the small end of the start shear pin. The diameter of the inner section is shorter than the outer diameter of the big end, and the depth of the outer section is not less than the length of the big end. The sum of the length of the small end and that of the start shear pin tail is greater than the depth of the inner section;

As shown in FIGS. 8 and 9, the outer barrel unlocking module comprises a connecting pipe 21 and a lock pin 22. The rear end of the connecting pipe 21 is threadedly connected to the lock body 11. The rear end of the lock pin 22 is threadedly connected to the locking rod 12. The central rod 14 passes through the inner cavity of the lock pin 22, and the outer diameter of the central rod 14 is shorter than the inner diameter of the lock pin 22. The central rod 14, the connecting pipe 21, the outer barrel 23, and the lock pin 22 are coaxial. The lock pin 22 is in the connecting pipe 21. The outer diameter of the front section of the connecting pipe 21 is shorter than the inner diameter of the outer barrel 23. The side wall of the front section of the connecting pipe 21 has unlocking holes. There are multiple unlocking holes, and these unlocking holes are evenly distributed along the circumference at the same axial position. The lock pin 22 has a groove A 221 on the outer wall. The inner wall of the outer barrel 23 has a groove B 231. The groove A 221 and the groove B 231 are both annular grooves. A pin 24 is also comprised. The length of the pin 24 is greater than the depth of the unlocking hole. The pin 24 is in the unlocking hole, and its outer end is chamfered. The side of the groove B 231 is a bevel. The angle between the outer chamfer of the pin 24 and the radial section is complementary to the angle between the side of groove B 231 and the radial section. The width of the groove A 221 is not less than the width of the inner end of the pin 24. The width of the groove B 231 is not less than the width of the outer end of the pin 24. The pin 24 includes the pin head and the pin body, and the pin head is on the inside. The unlocking hole is divided into the pin head section and the pin body section, and the pin head section is on the inside. The inner diameter of the pin head section is not less than the outer diameter of the pin head, while the inner diameter of the pin body section is not less than the outer diameter of the pin body. The length of the pin head is less than the depth of the pin head section, but the length of the pin body is greater than the depth of the pin body section. After activation, the inner end of the pin 24 is embedded in the groove A 221. The distance from the inner end surface of the pin 24 to the inner wall of the outer barrel 23 is greater than the length of the pin 24.

The connecting pipe 21 comprises a connecting section 211, a pressure relief section 212, and a choke section 213 from back to front. The outer diameter of the lock pin 22 is equal to the inner diameter of the choke section 213. The inner diameter of the choke section 213 is shorter than the inner diameter of the pressure relief section 212. There is a pressure relief hole 2121 in the pressure relief section 212, that is a through hole. The inner wall of the lock body 11 is provided with an end shear pin hole radially, and there is an end shear pin 25 in the end shear pin hole. The length of the end shear pin 25 is greater than the depth of the end shear pin hole. A shear plunger 26 is also comprised. The inner diameter of the shear plunger 26 is longer than the outer diameter of the lock pin 22 and the locking rod 12. The shear plunger 26 comprises a shear section 261 and a recoil section 262 from back to front. The outer wall of the shear section 261 is in a sealing fit with the inner wall of the lock body 11. The inner wall of the lock body 11 is provided with a sealing groove B, and there is a sealing ring in the sealing groove B. The sealing groove B is in front of the end shear pin hole. The outer diameter of the recoil section 262 is equal to the inner diameter of the pressure relief section 212 in the front of the pressure relief hole 2121. A sealing groove A is opened on the outer wall of the recoil section 262. A sealing ring is arranged in the sealing groove A. An end shear pin groove is opened on the outer wall of the shear section 261, while a diversion groove is opened on the outer wall of the connecting pipe 21. The diversion groove is right in front of the pressure relief hole 2121. The diversion groove is arranged axially, and connected with the pressure relief hole 2121. Before stopping the drilling, the front end of the recoil section 262 is in front of the front end of the pressure relief hole 2121. The recoil section 262 and the pressure relief section 212 in front of the pressure relief hole 2121 are in a sealing fit. The inner end of the end shear pin 25 is embedded in the end shear pin groove. After stopping the drilling, the front end of the recoil section 262 is behind the front end of the pressure relief hole 2121, and the end shear pin is cut off.

Figure 10:
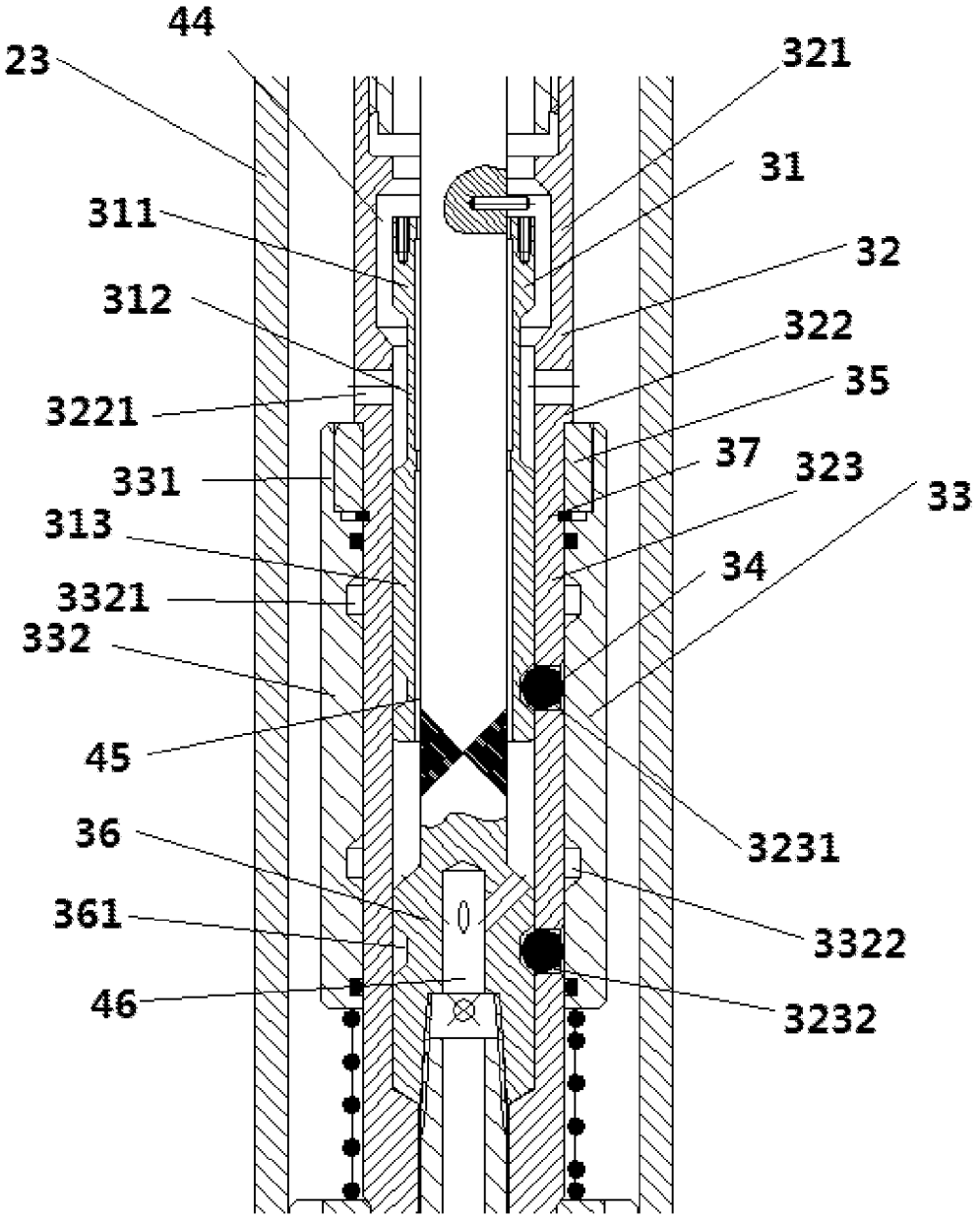
FIG. 10. Schematic diagram of the flow diverging module before stopping the drilling.
Figure 11:
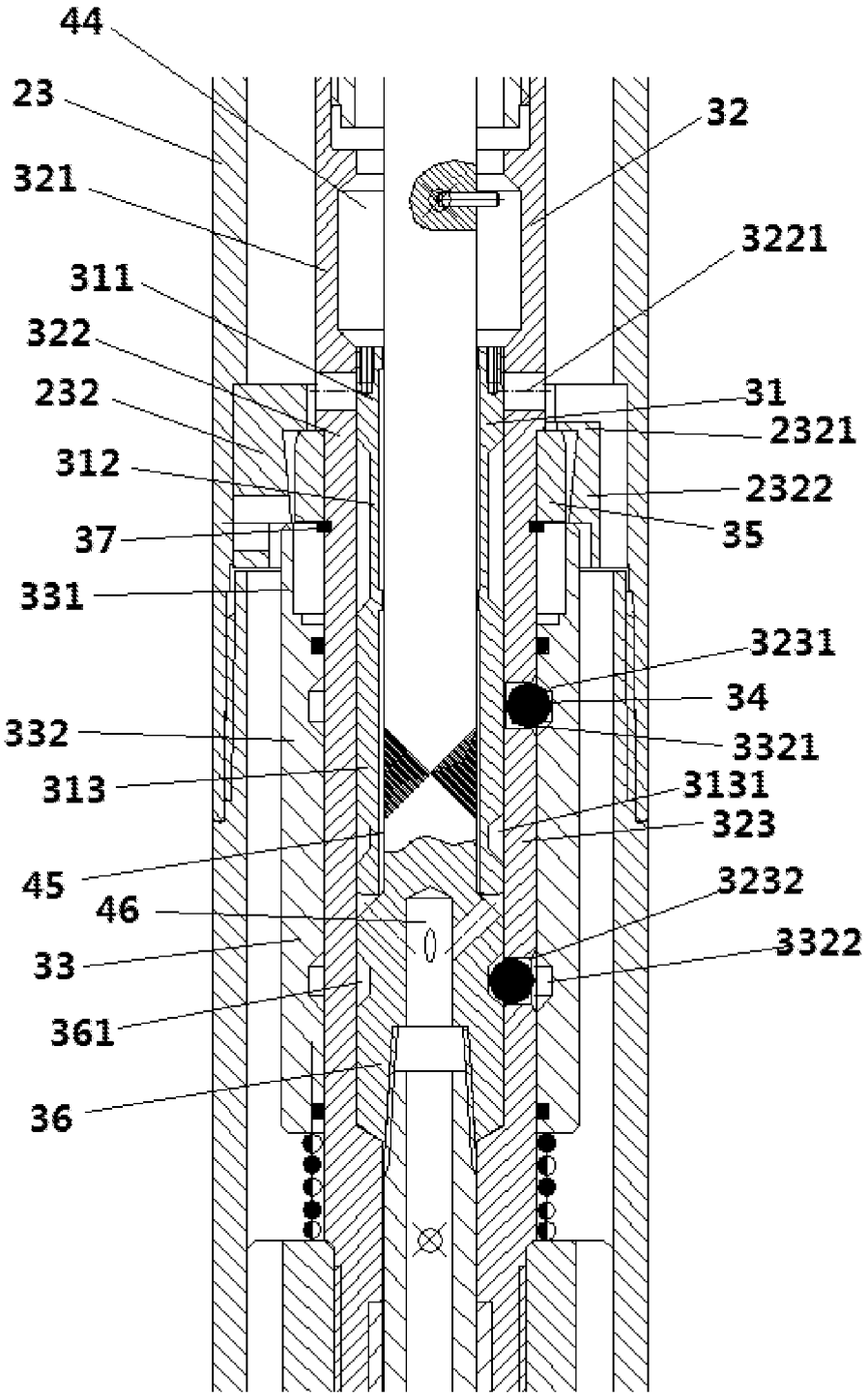
FIG. 11. Schematic diagram of the flow diverging module after stopping the drilling.

As shown in FIGS. 10 and 11, the flow diverging module includes a valve housing 31, a lock housing 32, a locking sleeve 33, and a fixing ring 35. The central rod 14, the valve housing 31, the lock housing 32, the locking sleeve 33, the fixing ring 35, and the outer barrel 23 are coaxial. The central rod 14 passes through the inner cavity of the valve housing 31, and the valve housing 31 is inside the lock housing 32. The lock housing 32 passes through the inner cavity of the locking sleeve 33, and the rear of the lock housing 32 is connected to the connecting pipe 21. The valve housing 31 includes a sealing section C 311, a diversion section 312, and a locking section A 313 from back to front. The outer wall of the locking section A 313 has a locking groove A 3131, that is an annular groove. The lock housing 32 includes an inflow section B 321, an outflow section B 322, and a locking section B 323 from back to front. The inner diameter of the inflow section B 322 is longer than the outer diameter of the sealing section C 311, while the outer diameter of the sealing section C 311 is longer than the outer diameter of the diversion section 312. The inner diameter of the outflow section B 322 is equal to the outer diameter of the sealing section C 311. The outflow section B 322 has an outflow hole B 3221. The locking section B 323 has a locking hole A 3231 and a locking hole B 3232. The locking hole B 3232 is in front of the locking hole A 3231. The outflow hole B 3221, the locking hole A 3231, and the locking hole B 3232 are all through holes with the same size. There are locking balls 34 in the locking hole A 3231 and the locking hole B 3232. The diameter of the locking ball 34 is greater than the depth of the locking hole A 3231. The locking sleeve 33 includes an impact section 331 and a locking section C 332 from back to the front. The inner wall of the locking section C 332 has a locking groove B 3321 and a locking groove C 3322, and the grooves are both annular with the same size. The locking groove C 3322 is in front of the locking groove B 3321. The distance between the locking groove B 3321 and the locking groove C 3322 is equal to the distance between the locking hole A 3231 and the locking hole B 3232. The distance between the bottom of the locking groove A 3131 and the inner wall of the locking section B 323 is less than the diameter of the locking ball 34. The distance from the bottom of the groove A3232 to the outer wall of the locking section B 323 is not less than the diameter of the locking ball 34. The distance from the bottom of the locking groove B 3321 and the locking groove C 3322 to the outer wall of the locking section B 323 is less than the diameter of the locking ball 34. The distance from the bottom of the locking groove B 3321 and the locking groove C 3322 to the inner wall of the locking section B 323 is not less than the diameter of the locking ball 34. The fixing ring 35 is fixed on the outer wall of the locking section B 323, and the fixing ring 35 is behind the locking hole A 3231. The inner diameter of the impact section 331 is longer than the outer diameter of the fixing ring 35. The locking section C 332 is in front of the fixing ring 35. The inner diameter of the outer barrel 23 is longer than the outer diameters of the lock housing 32 and the locking sleeve 33. The inner wall of the outer barrel 23 is connected to a safety gear 232. The safety gear 232 includes a clamping part 2321 and a pressing part 2322 from back to the front. The inner diameter of the front end face of the pressing part 2322 is shorter than the outer diameter of the impact section 331. The inner diameter of the pressing part 2322 is not less than the outer diameter of the fixing ring 35. The inner diameter of the front end face of the clamping part 2321 is shorter than the outer diameter of the rear end face of the fixing ring 35. The central rod 14 has a limiting portion 36, that is located in the locking section B 323. The limiting portion 36 is in front of the locking section A 313. The outer wall of the limiting portion 36 is provided with a locking groove D 361, that is an annular groove. The locking groove D 361 is in front of the locking groove A 3131. The gap between the outer wall of the limiting portion 36 and the inner wall of the lock housing 32 is shorter than the thickness of the front end of the locking section A 313. The axial distance from the front end face of the clamping part 2321 to the front end of the pressing part 2322 is equal to the axial distance from the center of the locking hole A 3231 to the center of the locking groove B 3321 before stopping the drilling. Before stopping the drilling, the distance from the rear end of the sealing section C 311 to the outflow hole B 3221 is greater than the axial distance from the center of the lock hole A 3231 to the center of the lock groove A 3131. After stopping the drilling, the axial distance from the center of the locking hole A 3231 to the center of the locking groove A 3131 is greater than the distance from the front end of the sealing section C 311 to the front end of the outflow hole B 3221 before stopping the drilling. The lock housing 32 and the valve housing 31 are locked or released from the restraint by the locking ball 34 in the locking hole A 3231. The lock housing 32 and the locking sleeve 33 are locked or released from the restraint through the locking ball 34 in the locking hole A 3231. The lock housing 32 and the central rod 14 are locked or unconstrained by the locking ball 34 in the locking hole B 3232. A snap ring 37 is also comprised, whose outer diameter is longer than the inner diameter of the fixing ring 35, and whose inner diameter is shorter than the inner diameter of the fixing ring 35. The snap ring 37 is inserted into the groove of the outer wall of the locking section B 323. The fixing ring 35 is clamped between the rear end of the snap ring 37 and the front end of the outflow section B 322. The front end of the locking section C 332 is supported by a spring. Before stopping the drilling, the lock housing 32 and the valve housing 31 are tightly locked to keep the fluid channel unobstructed. A safety gear 232 is arranged in the outer barrel 23. When the outer barrel 23 moves forward to a limiting position, the outer barrel 23 drives the safety gear 232 to hit the locking sleeve 33, causing the locking ball 34 in the locking hole A 3231 to move outward, and releasing the restraint on the valve housing 31. The valve housing 31 moves forward to close the fluid channel. The drilling is stopped. At this time, the locking groove D 361, the locking hole B 3232, and the locking groove C 3322 are directly facing each other, and the locking ball 34 in the locking hole B 3232 moves outwards, and the restriction on the central rod 14 is released.

The inner wall of the connecting section 121, the inner wall of the outflow section A 122, the rear end face of the sealing section B 123, and the outer wall of the central rod 14 enclose a fluid channel A 41. The inner wall of the lock body 11 and the outer wall of the locking rod 12 enclose a fluid channel B 42. The fluid channel C 43 is surrounded by the inner wall of the locking rod 12 and the outer wall of the central rod 14. The inner wall of the lock pin 22 and the outer wall of the central rod 14 enclose a fluid channel D 44. There is a fluid channel E 45 between the outer wall of the central rod 14 and the inner wall of the valve housing 31, and a fluid channel F 46 is opened in the limiting portion 36. The fluid channel B 42 and the fluid channel C 43 are connected through the inflow hole 1241; the fluid channel C 43 is connected with the fluid channel D 44; the back of the fluid channel E 45 is connected with the fluid channel D 44; the front of the fluid channel E 45 is connected with the fluid channel F 46; and the back of the fluid channel A 41 is connected with the fluid supply equipment. The front of the outflow hole B 3221 is connected to the driving liquid channel 74 of the driving motor 7, and the fluid channel F 46 is connected to the cooling hole of the drill bit in front of it.

The coring system is placed in the dental drill 5, and the latch 55 connected to the outer wall of the lock body 11 and the dental drill 5 are locked, so that the driving system for the core drilling rig is fixed above. The driving system for the core drilling rig is powered on by the mud pump at the rear. Before starting, the start shear pin 13 passes through the start shear pin hole and is inserted into the start shear pin groove. The locking rod 12 is fixed in the lock body 11 by the start shear pin 13. The axial distance from the outer wall opening of the outflow hole A 1221 to the rear end of the lock body 11 is less than the axial distance from the rear end of the fluid channel section 113 to the rear end of the lock body 11. The outer wall opening of the outflow hole A 1221 is closed by the sealing section A 112, and the liquid cannot flow forward. The front end of the connecting pipe 21 is in the outer barrel 23, and the pin 24 is in front of the groove A 221. The inner end of the pin 24 is slidingly fitted with the outer wall of the lock pin 22, while the outer end of the pin 24 is embedded in the groove B 231. The outer barrel 23 is fixed outside the connecting pipe 21 by the pin 24. After the hydraulic pressure provided by the rear mud pump reaches the starting value, it impacts the rear end of the locking rod 12 to cut off the start shear pin 13, and the start shear pin 13 breaks into the start shear pin head and the start shear pin tail. The start shear pin head is in the start shear pin hole, while the starting shear pin tail is in the start shear pin groove. The locking rod 12 moves forward. The axial distance from the outer wall opening of the outflow hole A 1221 to the rear end of the lock body 11 is greater than the axial distance from the rear end of the fluid channel section 113 to the rear end of the lock body 11. The fluid channel A 41 and the fluid channel B 42 are connected through the outflow hole A 1221. Fluid channel A 41, fluid channel B 42, fluid channel C 43, fluid channel D 44, fluid channel E 45, and fluid channel F 46 are connected, and fluid channel D 44 is connected to the driving liquid channel 74 of the driving motor 7 by outflow hole B 3221. The front of the fluid channel F 46 is connected to the cooling hole of the drill bit 8, and the hydraulic energy provided by the mud pump behind the fluid channel A 41 can be transmitted to the driving motor 7 and the drill bit 8 ahead through the fluid channel A 41, the fluid channel B 42, the fluid channel C 43, the fluid channel D 44, the fluid channel E 45 and the fluid channel F 46, so as to make the outer rotor 73 rotate and cool the drill bit 8. The locking rod 12 drives the lock pin 22 to move forward. The inner end of the pin 24 is in a sliding fit with the outer wall of the lock pin 22. When the groove A 221 slides forward to the same axial position as the pin 24, the outer barrel 23 generates forward pressure by its own gravity, and the contact surface of the groove B 231 and the pin 22 is an inclined surface. The groove B 231 presses the inclined surface of the pin 24. The pin 24 withdraws from the groove B 231 and is pressed into the groove A 221, to release the restraint of the outer barrel 23. The outer barrel 23 drives the front-connected working parts to move forward. The outer cylinder 23 is connected to the outer rotor 73 of the driving motor 7, and the front end of the outer cylinder 23 is connected to the drill bit 8. The centralizer connected to the outer wall of the outer cylinder 23 is in contact with the inner wall of the dental drill 5, so that the outer cylinder 23 is vertically centered. When the drilling rig is working, the outer barrel 23 moves from back to front. The fluid flows into the liquid channel D 44 through the fluid channel A 41, the fluid channel B 42, and the fluid channel C 43. The fluid channel D 44 is connected to the driving liquid channel 74 of the driving motor 7 ahead through the outflow hole B 3221. Moreover, the fluid channel D 44 is connected to the cooling hole of the drill bit 8 in front through the fluid channel E 45 and the fluid channel F 46. The locking ball 34 in the locking groove A 3131 and the locking hole A 3231 restricts the valve housing 31 from moving forward. The outer barrel 23 drives the safety gear 232 to move forward. After the outer barrel 23 moves to the limit position, the safety gear 232 hits the locking sleeve 33, to make the locking groove B and the locking hole A directly face each other. The fluid in the fluid channel D 44 impacts the rear end of the valve housing 31, squeezing the locking ball 34 into the locking groove B, and the valve housing 31 is released from the restraint and moves forward. The sealing section C 311 moves into the outflow section B 322, blocks the channel between the fluid channel D 44 and the outflow hole B 3221, and cuts off the fluid channel. Consequently, the driving motor 7 stops rotating, the fluid flows back to the fluid channel B 42, and backflushes the recoil section 262 to make it move backwards. The end shear pin 25 is cut off, and thus the fluid channel B 42 and the pressure relief hole 2121 are connected, and the pressure is relieved through the pressure relief hole 2121.

Of course, there still may be many other examples for the present invention. Without departing from the spirit and the essence of the present invention, those skilled in the art can make various corresponding changes and deformations according to the invention, but these corresponding changes and deformations shall belong to the protection scope of the claims of the present invention.

The invention claimed is:

1. A driving system for a core drilling rig, comprising:

a driving motor (7) and a fluid activation module, wherein the driving motor (7) comprises an outer rotor (73) and an inner stator (75), and mutually-matched convex ribs (77) are provided on an inner wall of the outer rotor (73) and an outer wall of the inner stator (75), wherein the outer rotor (73) and the inner stator (75) are in clearance fit and a clearance between the outer rotor (73) and the inner stator (75) is a driving liquid channel (74), wherein a length of the outer rotor (73) is less than that of the inner stator (75), wherein the outer rotor (73) is provided between a front end and a rear end of the inner stator (75), wherein outer rotor (73) is connected to an outer cylinder (23), and the rear end of the inner stator (75) is connected to a coupling (76), wherein the fluid channel activation module is disposed behind the inner stator (75) and comprises a lock body (11), a locking rod (12), and a start shear pin (13), wherein a locking rod (12) is in the lock body (11), and the locking rod (12) and the lock body (11) are connected by the start shear pin (13), wherein a central rod (14) is in the locking rod (12), while a sealing section A (112) of the lock body (11) and a sealing section B (123) of the locking rod (12) are in a sealing fit, the sealing section B (123) is in a sealing fit with the central rod (14), a fluid channel A (41) is disposed between the central rod (14) and the locking rod (12), and the locking rod (12) has an outflow hole A (1221) on an outer wall thereof, wherein the outflow hole A (1221) is disposed behind the sealing section B (123), wherein a fluid channel B (42) is disposed between the lock body (11) and the locking rod (12), and in front of the sealing section A (112), wherein an opening of the outflow hole A (1221) is at the sealing section A (112), and a front end of the fluid channel A (41) is sealed, a front of the lock body (11) is connected to the inner stator (75), and a front of the fluid channel B (42) is connected to the driving liquid channel (74).

2. The driving system for a core drilling rig according to claim 1, wherein a hydraulic pump is connected to the driving liquid channel (74).

3. The driving system for a core drilling rig according to claim 1, wherein the outer cylinder (23) is provided with a driving liquid outlet (72), and the driving liquid outlet (72) is disposed in front of the outer rotor (73).

4. The driving system for a core drilling rig according to claim 1, the central rod (14) extends through an inner cavity of the inner stator (75) and the coupling (76), and the central rod (14) is connected to a core barrel disposed in front of the inner stator (75).

5. The driving system for a core drilling rig according to claim 1, further comprising an outer cylinder unlocking module that comprises a connecting pipe (21) and the lock pin (22), wherein a rear end of the connecting pipe (21) is connected to the lock body (11), while a rear end of the lock pin (22) is connected to the locking rod (12), the lock pin (22) is disposed in the connecting pipe (21), wherein a front section of the connecting pipe (21) is connected in the outer cylinder (23), and a side wall of the front section of the connecting pipe (21) has an unlocking hole, a groove A (221) is disposed on the outer wall of the lock pin (22), a groove B (231) is disposed on an inner wall of the outer cylinder (23), and a pin (24) is arranged in the unlocking hole, a length of the pin (24) is greater than a depth of the unlocking hole, a width of groove A (221) is not less than a width of the inner end of the pin (24), a width of the groove B (231) is not less than a width of an outer end of the pin (24), a front end of the connecting pipe (21) is disposed in the outer cylinder (23), and the pin (24) is disposed in front of the groove A (221), wherein an inner end surface of the pin (24) is in sliding fit with an outer wall of the lock pin (22), and the outer end of the pin (24) is embedded in the groove B (231).

6. The driving system for a core drilling rig according to claim 5, further comprises a flow diverging module that comprises a valve housing (31), a lock housing (32) and a trigger mechanism, wherein the valve housing (31) is disposed inside the lock housing (32), and a rear of the lock housing (32) is connected to the connecting pipe (21), wherein the valve housing (31) comprises a sealing section C (311) and a diversion section (312), the lock housing (32) includes an inflow section B (321) and an outflow section B (322), a fluid channel D (44) is disposed between the central rod (14) and the inflow section B (321), a fluid channel E (45) is disposed between the outer wall of the central rod (14) and the inner wall of the valve housing (31), a back end of the fluid channel D (44) communicates with the fluid channel B (42), and the fluid channel E (45) communicates with the fluid channel D (44), and the fluid channel E (45) communicates with a cooling hole of a front drill bit, and an inner diameter of the inflow section B (322) is longer than an outer diameter of the sealing section C (311), while an outer diameter of the sealing section C (311) is longer than an outer diameter of the diversion section (312), and an inner diameter of the outflow section B (322) is equal to an outer diameter of the sealing section C (311), the outflow section B (322) is provided with an outflow hole B (3221), and the outflow hole B (3221) communicates with the driving liquid channel (74) of the driving motor (7), and a front end of sealing section C (311) is in the inflow section B (321), wherein the fluid channel D (44) and the outflow hole B (3221) are connected, and a front end of the lock housing (32) is connected to a rear end of the coupling (76).

7. The driving system for a core drilling rig according to claim 6, wherein the valve housing (31) further comprises a locking section A (313) connected to an front end of the diversion section (312), wherein the lock housing (32) further comprises a locking section B (323) connected to the front end of the outflow section B (322), the inner wall of the outer cylinder (23) is connected to a safety gear (232), wherein the trigger mechanism comprises a locking sleeve (33), a fixing ring (35), and a safety gear (232), the lock housing (32) passes through an inner cavity of the locking sleeve (33), and an outer wall of the locking section A (313) is provided with a locking groove A (3131), wherein the locking section B (323) has a locking hole A (3231) and a locking hole B (3232) disposed in front of the locking hole A (3231), the locking hole A (3231) and the locking hole B (3232) are through holes and each contains a locking ball (34) a diameter of the locking ball (34) is longer than a depth of the locking hole A (3231), the locking sleeve (33) includes an impact section (331) and a locking section C (332), an inner wall of the locking section C (332) has a locking groove B (3321) and a locking groove C (3322), the locking groove C (3322) is disposed in front of locking groove B (3321), a distance between the locking groove B (3321) and the locking groove C (3322) is equal to a distance between the locking hole A (3231) and the locking hole B (3232), the fixing ring (35) is affixed on an outer wall of the locking section B (323), and the fixing ring (35) is disposed behind the locking hole A, an inner diameter of the impact section (331) is longer than lithell an outer diameter of the fixing ring (35), the safety gear (232) includes a clamping part (2321) and a pressing part (2322), an inner diameter of the front end of the pressing part (2322) is shorter than an outer diameter of the impact section (331), an inner diameter of the pressing part (2322) is not less than the outer diameter of the fixing ring (35), an inner diameter of the front end of the clamping part (2321) is shorter than an outer diameter of the rear end of the fixing ring (35), a limit part (36) is disposed at a front end of the central rod (14), and the limit part (36) is disposed in the locking section B (323) of the lock housing (32), an outer wall of the limit part (36) is provided with a locking groove D (361), a fluid channel F (46) is opened to inside of the limit part (36), the fluid channel F (46) is connected to the fluid channel E (45).

8. The driving system for a core drilling rig according to claim 7, wherein a fluid channel C (43) is disposed between the central rod (14), the lock pin (22) and the locking rod (12), a side wall of the locking rod (12) is provided with an inflow hole (1241), the fluid channel B (42) communicates with the fluid channel C (43) through the inflow hole (1241), the fluid channel C (43) communicates with the fluid channel D (44), wherein the connecting pipe (21) includes a pressure-relief section (212) and a choke section (213), the lock pin (22) and the choke section (213) are in a sealing fit, and an inner diameter of the choke section (213) is shorter than an inner diameter of the pressure-relief section (212), the pressure-relief section (212) is provided with a pressure-relief hole (2121) that is a through hole, shearing plunger (26) is disposed in the fluid channel B (42), and an inner diameter of the shearing plunger (26) is longer than outer diameters of both the lock pin (22) and the locking rod (12), the shearing plunger (26) is connected to the lock body (11) through an end shearing pin (25), the shearing plunger (26) includes a shearing section (261) and a recoil section (262), an outer wall of the shearing section (261) is in a sealing fit with an inner wall of the lock body (11), and an outer diameter of the recoil section (262) is equal to an inner diameter for the front part of the pressure-relief hole (2121) in the pressure-relief section (212).

* * * * *